US005848577A

United States Patent [19]

Sappé et al.

[11] Patent Number: 5,848,577

[45] Date of Patent: Dec. 15, 1998

[54] INTERNAL-COMBUSTION ENGINE STARTER DEVICE

[75] Inventors: Levi Sappé , Villareggia; Giorgio Alotto, Condove, both of Italy

[73] Assignee: Magneti Marelli S.p.A., Italy

[21] Appl. No.: 857,264

[22] Filed: May 16, 1997

[30] Foreign Application Priority Data

May 21, 1996 [IT] Italy ..... TO96A0433

[51] Int. Cl.[6] ..... F02N 11/08

[52] U.S. Cl. ..... 123/179.3; 290/38 R

[58] Field of Search ..... 123/179.3; 290/38 R, 290/38 C

[56] References Cited

U.S. PATENT DOCUMENTS

| | | | |
|---|---|---|---|
| 3,783,301 | 1/1974 | Nieukirk | 290/38 R |
| 4,549,089 | 10/1985 | Buetemeister et al. | 290/38 R |
| 4,896,637 | 1/1990 | Yamamoto | 123/179.3 |

FOREIGN PATENT DOCUMENTS

| | | |
|---|---|---|
| 0562456A1 | 9/1993 | European Pat. Off. . |
| 0562547A1 | 9/1993 | European Pat. Off. . |
| 0526985A2 | 10/1993 | European Pat. Off. . |

*Primary Examiner*—Andrew M. Dolinar
*Attorney, Agent, or Firm*—Hall, Priddy & Myers

[57] ABSTRACT

Starter device comprising an electric starter motor and a main switch of the normally open type connected between a supply input of the electric motor and a battery. The device comprises a main switch activation circuit comprising a first and a second switches arranged in series with each other and connected between the battery and a main switch activation device. The first switch is in the form of a manually operated switch operated by an ignition key and the second switch, of the normally open type, is closed by a power enable signal output by an electronic control circuit designed to inhibit the production of the enable signal when the voltage of the battery falls below a threshold value. An electrical connection device extends between the supply input of the main switch and a control input of the second switch in order to provide a supply voltage to the control input and keep the second switch closed independently of the production of the enable signal.

7 Claims, 1 Drawing Sheet

INTERNAL-COMBUSTION ENGINE STARTER DEVICE

BACKGROUND OF THE INVENTION

The present invention relates to an internal-combustion engine starter device.

There are starter devices for internal-combustion engines in the prior art comprising an electric starter motor able to turn the crankshaft and a main power switch connected between a starter motor activation input and the battery of a motor vehicle. This main switch is of the normally open type and is usually a relay with an energizing solenoid which, when energized, causes the main switch to close. The starter device also includes, for the main switch, a supply circuit comprising a first switch and a second switch arranged in series with each other and connected between the battery and the solenoid; in particular the first switch is conveniently in the form of a manually operated switch incorporated in an ignition switch for starting the vehicle, operated by an ignition key. The second switch, which may take the form of a relay, is of the normally open type and is made to close by a power enable signal produced by an electronic control circuit and sent to a control input of the second switch. The electronic control circuit is powered by the battery and is designed to inhibit the production of the enable signal when the supply voltage to the electronic circuit falls below a threshold value. In order to start the engine, the first switch is closed for a few seconds, thus energizing the solenoid and so closing the main switch and turning the electric motor; during this cranking phase the second switch is normally kept closed by the electronic control circuit.

During the cranking of the internal-combustion engine, the electric motor draws a heavy current from the battery (of the order of a hundred amps) and the voltage of the battery may fall below its rated value (normally 12 volts); for this reason the voltage supplied to the control circuit may itself fall below the threshold value, causing the immediate opening of the second switch and consequently cutting out the starter motor. Clearly, if the starter motor cuts out before the internal-combustion engine is self-sustaining, it will be impossible to start the latter.

SUMMARY OF THE INVENTION

The object of this invention is to provide a starter device capable of keeping the electric starter motor turning even when the electronic control circuit produces a signal causing the second switch to open and consequently cutting out the starter motor.

According to the present invention an internal-combustion engine starter device of the type described in claim 1 is provided.

BRIEF DESCRIPTION OF THE DRAWINGS

The invention will now be described with reference to the accompanying drawings, which illustrate a non-limiting example of an embodiment thereof, in which.

DETAILED DESCRIPTION OF THE INVENTION

Figure 1:
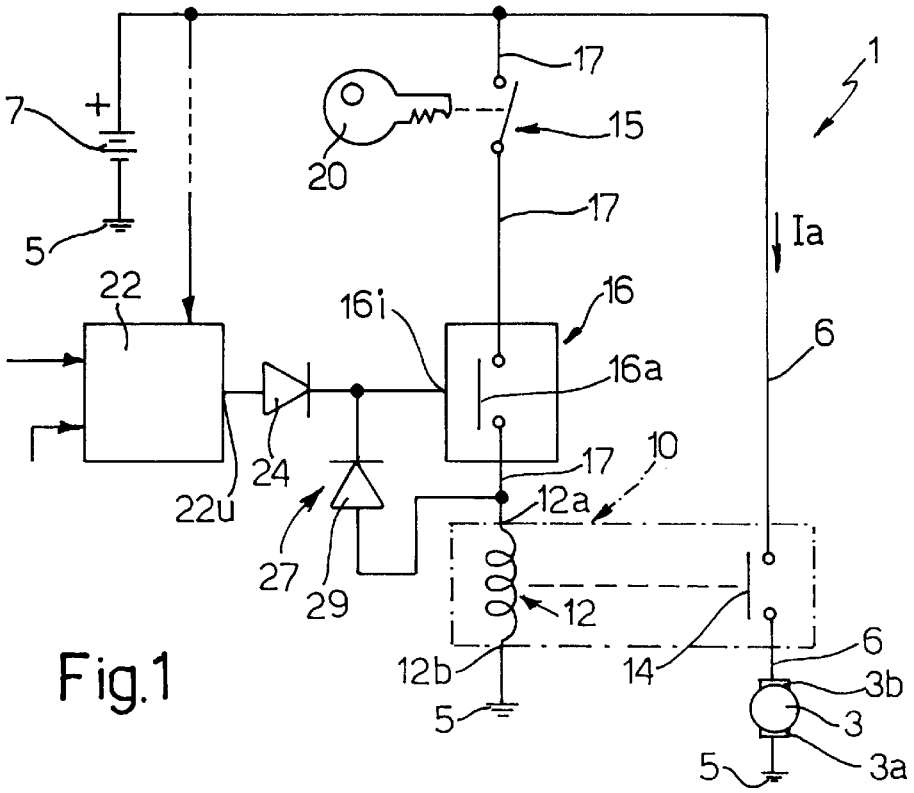
FIG. 1 is a schematic of a starter device for an internal-combustion engine made in accordance with the teaching of the present invention and FIG. 2 shows a variant of the device shown in FIG. 1.

In FIG. 1 the reference numeral 1 denotes the whole of a starter device in which an electric motor 3 (shown schematically) is able to start an internal-combustion engine (not shown) such as a petrol engine in a vehicle (not shown). The electric starter motor 3 has a first terminal 3*a* connected to a reference potential 5 (earth) and a second terminal 3*b* that can be connected by a power line 6 to the positive pole (+) of a power source 7, which will conveniently be the battery of the vehicle (not shown). The starter device 1 comprises a power switching device 10 housed in the casing (not shown) of the motor 3 and arranged on the power line 6 between the power source 7 and the terminal 3*b;* the switch device 10 is of the normally open type and, when kept closed, allows a power current $I_a$ to pass from the battery 7 to the starter motor 3. More specifically, the switch device 10 may advantageously take the form of a relay comprising a solenoid (shown schematically) acting on a movable element (not shown) capable of moving an electric contact 14 between a rest position in which the solenoid is not energized and the switch device 10 is open, and an activated position in which the switch device 10 is closed while a supply voltage of a few volts is applied to the solenoid.

The starter device 1 also comprises a circuit for activating the switch device 10 comprising first and second switches 15 and 16 arranged in series with each other on an electric line 17 that extends between the positive terminal (+) of the battery 7 and a first terminal 12*a* of the solenoid 12, which also has a second terminal 12*b* connected to the reference potential 5. The first switch 15 is conveniently in the form of a manually operated switch incorporated in an ignition switch for starting the vehicle, operated by an ignition key 20. The second switch 16 comprises a relay with a control input 16*i* connected, via a separating diode 24, to an output 22*u* of an ignition control circuit 22 (of known type). The relay 16 comprises an electric contact 16*a* that can be moved between a rest position in which the relay is not energized and the switch 16 is open, and an activated position in which the relay 16 is energized and the switch 16 is closed.

The ignition control circuit 22 (of known type) is powered by the battery 7 and its input receives a plurality of electrical signals measured in the engine/in the vehicle and delivers enable and/or control signals through its output; in particular, where the signals fed to the input of the circuit 22 identify a situation of normal running of the engine, an ignition enable signal is delivered at the output 22*u* allowing the relay 16 to be energized and thus closing the switch formed by this relay.

Among the various functions performed by the circuit 22 is a safety function whereby, if the supply voltage to the circuit 22 falls below a threshold value, the production of the ignition enable signal is inhibited, thus de-energizing the relay 16 and causing the switch represented by this relay 16 to open as a consequence.

In the present invention the starter device 1 comprises an electrical connection device 27 extending between the control input 16*i* of the second switch 16 and the terminal 12*a* of the solenoid 12; in the preferred embodiment shown in FIG. 1 the electrical connection device 27 comprises a diode 29 whose anode is connected to the terminal 12*a* and whose cathode is connected to the control input 16*i*. The diode 29 allows current to flow from the terminal 12*a* to the control input 16*i* of the second switch 16 but prevent it from flowing in the opposite direction.

When in use, in conditions of normal running of the engine and where the supply voltage to the circuit 22 exceeds the threshold value, the control circuit 22 produces an ignition enable signal that causes the switch 16 to close; in this situation, as a result of the closure of the switch 15, the solenoid 12 is energized, which causes the power switching device 10 to close and consequently supplies power to the electric motor 3 which then cranks the crankshaft (not shown) of the internal-combustion engine (not shown). During the cranking of the internal-combustion engine, the electric motor 3 draws a heavy current (normally of the order of a hundred amps) which flows from the battery 7 along the power line 6. During this cranking phase, the voltage of the battery 7 may fall below the rated value, causing the voltage supplied to the control circuit 22 to fall below the threshold value; in this situation the production of the enable signal is inhibited and the circuit 22 ceases to provide a supply voltage to the relay 16 which, if it were supplied only by the control circuit 22, would be de-energized. In the present invention the control input **16*i* is also connected to the battery 7 through the electrical connection device 27 (diode 29), the second switch 16 (which is closed), the first switch 15 (which is kept closed during cranking) and the power line 17; therefore, after the switches 15 and 16 have closed, and even if the circuit 22 has ceased to provide the activation signal, the relay 16 continues to be energized because the voltage for its activation is being drawn downstream of the switches 15 and 16, which are closed and connected to the battery 7. When the first switch 15 is opened the second switch 16** is however de-energized and comes open.

Figure 2:
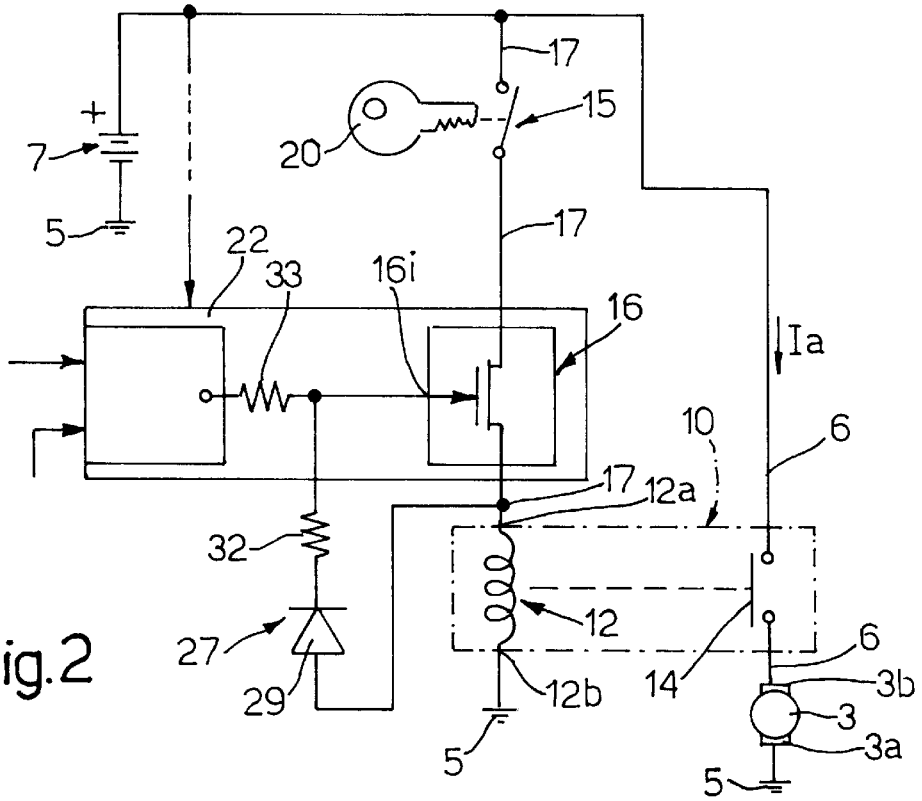

The starter device shown in FIG. 2 differs from that illustrated in FIG. 1 in that the second switch takes the form of a solid-state electronic device, such as a MOS transistor, and in that the second switch is internal to the control circuit 22. The drawing also shows a resistor 32 connected between the control input **16*i* and the diode 29 and a resistor 33 with one terminal connected to the input 16*i* and another terminal receiving the enable signal. The way this device works is exactly the same as the device shown in FIG. 1** and, for brevity's sake, will not be repeated here.

The first switch 15 could also be non-manual and could take the form of an automatically operated electronic switch—for example a switch controlled by an electronic control system designed to extinguish the engine automatically when the vehicle stops at traffic lights and start the engine automatically when the accelerator pedal is operated (the so-called START/STOP function).

We claim:

1. An internal combustion engine starter device which comprises:

an electric starter motor;

a voltage source;

a first normally open switch having an input terminal and connected between said starter motor and said voltage source;

an electrical connection mechanism for closing said first normally open switch thereby to start said electric starter motor by drawing voltage from said voltage source; said mechanism including a second operator actuated switch and a third normally open switch connected in series between said second switch and said first switch, said third switch having a control terminal for closing said third switch, an input terminal and an output terminal connected to said input terminal of said first switch; and an ignition control device connected to said voltage source and having an output terminal connected to said control terminal of said third switch, said ignition control device being so designed as to be incapable of providing sufficient voltage from its said output terminal to said third switch to maintain closure of said third switch once closure of said third switch is established if the voltage from said voltage source thereafter falls below a threshold value when said second switch is closed;

said electrical connection mechanism further comprising an electrical connection for providing voltage from said output terminal of said third switch to said control terminal of said third switch, said electrical connection being so located that when said first, second and third switches are closed thereby to start said starter motor, the combined voltage provided to said control terminal of said third switch is sufficient to maintain the closure of said third switch when said second switch is closed.

2. A device according to claim 1 wherein said electrical connection between said output terminal of said third switch and said control terminal of said third switch allows current to flow from said output terminal of said third switch to said control terminal of said third switch and prevents current from flowing in the opposite direction.

3. A device according to claim 2 wherein said electrical connection includes at least one diode.

4. A device according to claim 1 wherein said first normally open switch comprises a relay with a solenoid.

5. A device according to claim 1 wherein said third switch includes a relay.

6. A device according to claim 1 wherein said third switch further includes a semiconductor switch with a control input communicating with said output terminal of said ignition control device and with said electrical connection.

7. A device according to claim 1 wherein said device further includes an ignition switch for starting said engine, said ignition switch being key operated and including said second switch.

* * * * *